US005193694A

United States Patent [19]

Wave

[11] Patent Number: 5,193,694

[45] Date of Patent: Mar. 16, 1993

[54] SKI AND SKI POLE STORING RACK

[76] Inventor: Ian Wave, 8122 NE. 190th St., Bothell, Wash. 98011

[21] Appl. No.: 812,162

[22] Filed: Dec. 23, 1991

[51] Int. Cl.[5] ..... A47F 7/00

[52] U.S. Cl. ..... 211/70.5; 211/60.1

[58] Field of Search ..... 211/70.5, 60.1

[56] References Cited

U.S. PATENT DOCUMENTS

| | | | |
|---|---|---|---|
| 3,421,725 | 1/1969 | Glass | 211/70.5 X |
| 3,636,739 | 1/1972 | Smedley | 211/70.5 X |
| 4,078,708 | 3/1978 | Mayer | 211/70.7 X |
| 4,508,229 | 4/1985 | Yost, Jr. | 211/70.5 |
| 4,798,298 | 1/1989 | Ursetta | 211/70.5 |

OTHER PUBLICATIONS

Popular Mechanics, p. 124 Feb., 1978.

*Primary Examiner*—J. Franklin Foss

[57] ABSTRACT

A combined unit fastenable on a vertical support such as two adjacent wall studs, 16 inch center to center, or any solid wall to hold or store any two various, in size and nature, pairs of skis and ski poles during and or off ski season in the best possible position so that skis will be off the floor and locked in place, to maintain their manufactured camber by means of two supporting members, at their tips and ends, with the least outward projection of skis' bindings.

This system has an upper and two lower members whereby hold two pairs of skis by placing the skis sideways along their edges in bottom- to-bottom facing arrangement, in a cylindrical slot provided by the upper member and bringing them down and inserting the skis' ends into a pouch provided by the lower member. These two members are fastened onto a vertical support in a unique fashion so that they apply supportive force onto the skis' tips and the ends simultaneously. A stretchable elastic element attached to the upper member will be pulled and placed over the positioned skis afterward to lock them in place. The upper member also has two projecting cylindrical elements whereby two pairs of strapped or strapless ski poles may be securely hung.

3 Claims, 3 Drawing Sheets

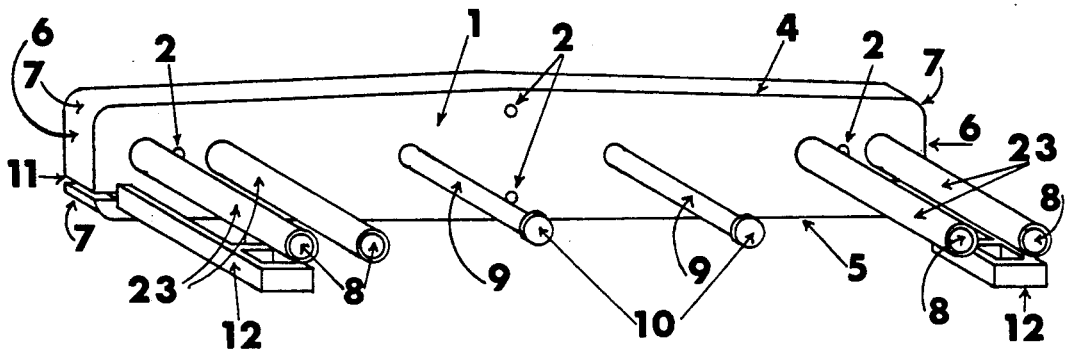
FIG. 2 , PART A
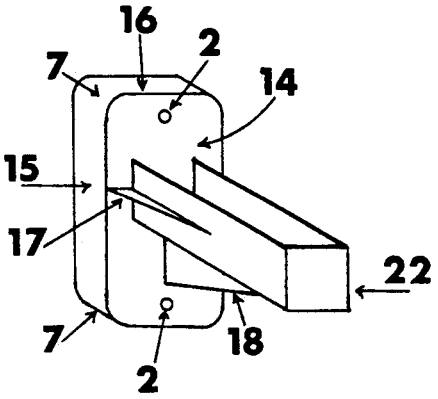
FIG. 3, PART B
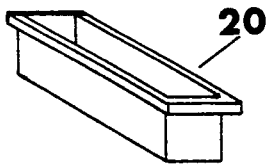
FIG. 4
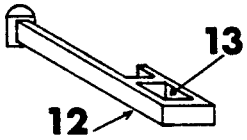
FIG. 5
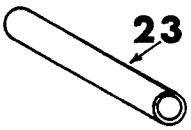
FIG. 6
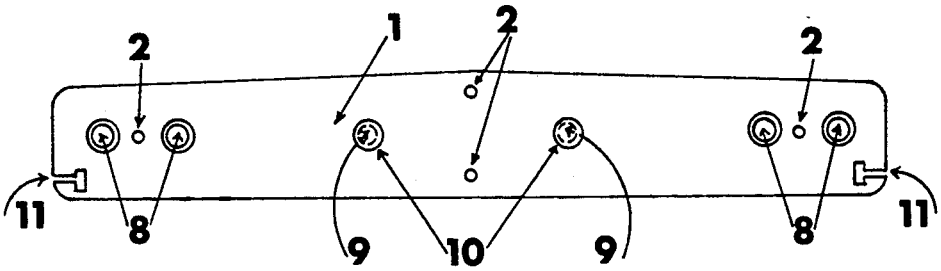
FIG. 7

SKI AND SKI POLE STORING RACK

BACKGROUND ART

Storage and reservation of skis and poles, both during and off ski season create numerous problems for a skier and his or her surroundings, most serious of them all being accidental falls causing fatal injuries and materialistic damages in today's expensive equipment.

There have been variety of designs proposed in the past but none to my understanding is as convenient and competent, particularly in protection of skis, as the present design to a skier family. In particular, in U.S. Pat. No. 4,222,490 issued Sep. 16, 1980 a storage apparatus is proposed which consists of a similar appearance but entirely different design than the present proposal, in a way that a pair of skis exert all of their weight upon the bottom section of this apparatus, developing possible additional camber before they are secured in place by two eccentric cylinder assemblies which deserves to be admired, but offers its own use and place. Where as the present invention uses a unique physical phenomenon to support the skis at two sections and across in an upright orientation simultaneously which is by far a more desirable way of storing a slender object.

FIELD OF INVENTION

This invention relates to a storage system for two pairs of skis and ski poles of various lengths and kinds in a unique fashion, having two supporting grips at two sections, across the skis, thereby protecting their natural camber as well as their edge and surface finish.

OBJECTS OF INVENTION

It is therefore an object of the present invention to provide an improved storage system which is most convenient to a skier. Another object is to provide such a unit which is made of selected and proper materials and introduces the best method possible as to protect skis against warpage and damage or mar. Yet another object is to offer an american or american resident skier a unit which will be installed with the least effort on a wall built according to the U.S. building codes in a most practical way. Still another object of this invention is to prevent any accidental disengagement of skis from the unit and injuries to a nearby playful child.

BRIEF DESCRIPTION OF DRAWINGS

In order that the present invention may be readily comprehensible, reference will now be made to the accompanying drawings in which like reference characters refer to like elements, and in which:

FIG. 2 is a perspective view of upper section of the unit according to one embodiment of the invention.

FIG. 3 is a perspective view of lower section of the unit according to one embodiment of the invention.

FIG. 4 is a perspective view of a protective lining which would be inserted into the member shown in FIG. 3.

FIG. 5 is a perspective view of the stretchable elastic member, attached to two ends of the member shown in FIG. 2.

FIG. 6 is a perspective view of the protective sleeves which cover the cylindrical elements of the member shown in FIG. 2.

FIG. 7 is a front view of the member shown in FIG. 2 excluding the elastic elements shown in FIG. 5.

DESCRIPTION OF PREFERRED EMBODIMENT

Figure 1:
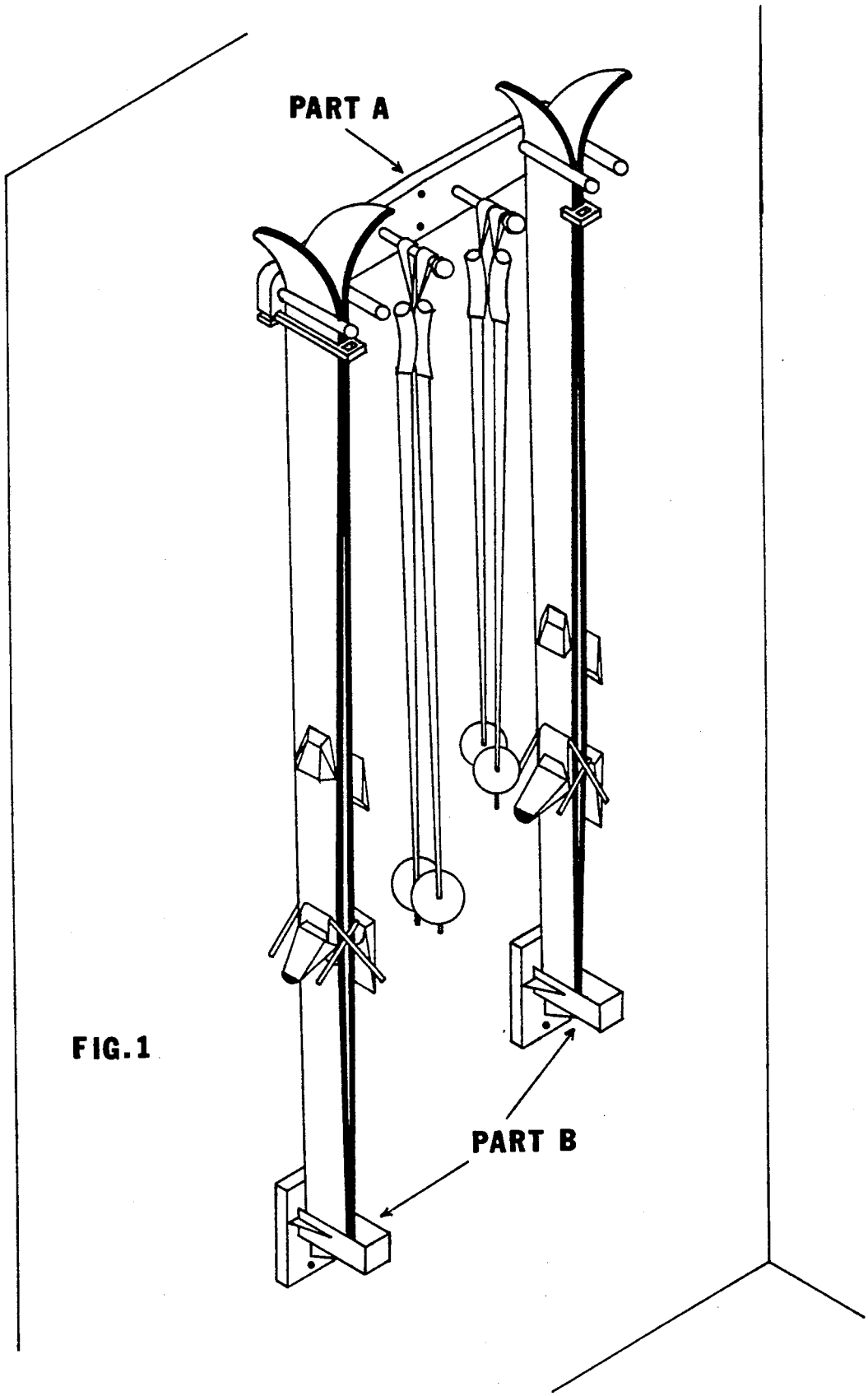
FIG. 1 is a perspective view of the unit fastened on a vertical wall and holding two pairs of different size skis and poles to show its function and use.
Figure 8:
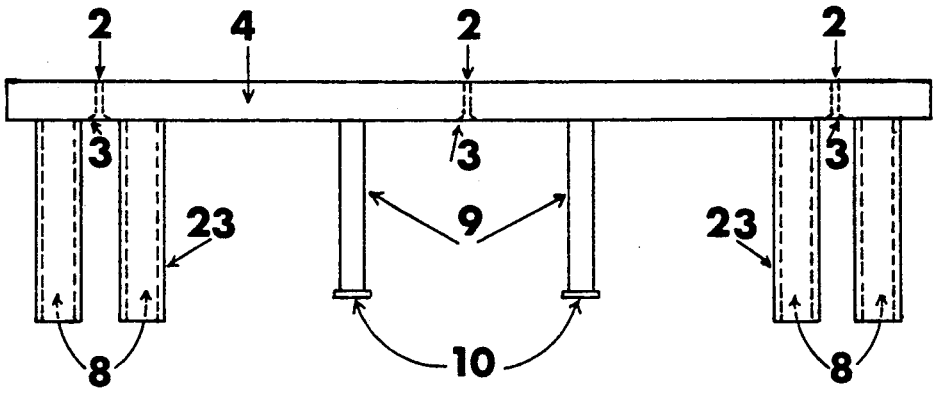
FIG. 8 is a top view of the member shown in FIG. 2 excluding the elastic elements shown in FIG. 5.
Figure 9:
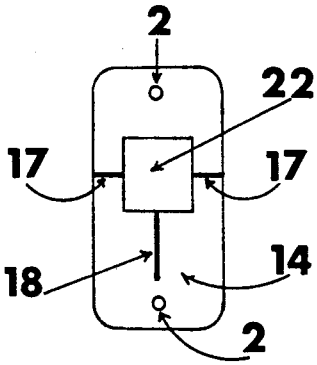
FIG. 9 is a front view of the members shown in FIG. 3 excluding the lining shown in FIG. 4.
Figure 10:
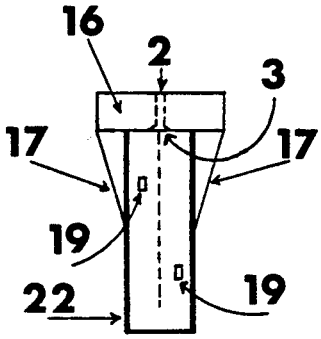
FIG. 10 is a top view of the members shown in FIG. 3 excluding the lining shown in FIG. 4.
Figure 12:
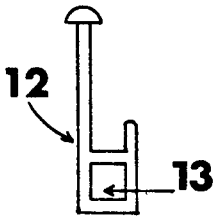
FIG. 12 is a top view of the elastic elements shown in FIG. 5.
Figure 11:
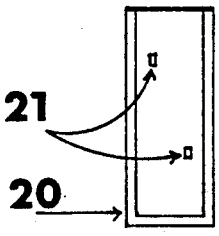
FIG. 11 is a top view of the protective lining shown in FIG. 4.

The ski and ski pole storing rack shown in the drawings is combined of one upper section, part A shown in FIG. 2, and two lower sections, part B shown in FIG. 3.

Part A includes a rigid and smooth surface base element 1 which is a flat, rectilinear element defined by longer peripheral top 4, bottom 5 and short sides 6. Corners 7 of the base are rounded for safety and appearance.

Dimensions of the base 1 are as follows: the length, width and depth measure around 24", 4" and 1" respectively, the base 1 has two fixed cylindrical elements 8, projecting perpendicularly outward, spaced to define a slot at each end for receiving the skis along their edges at the tips.

The base 1 has two other fixed cylindrical elements 9, projecting perpendicularly outward, spaced apart from each other and having caps 10 at outer ends for hanging two pairs of ski poles through their straps or handles that can not free themselves, the size of these elements 8 and 9 are about 5" long and 1" in diameter.

The base 1, cylindrical elements 8, 9 and also part B which will be reviewed later, have inner bracing elements for stability and strength reasons and are made of rigid and durable plastic substance.

The base 1 having four fastening holes 2 of which two outward ones along horizontal axis, are spaced 16" apart as to be placed on two adjacent wall studs positioned 16", center-to-center, apart according to the U.S. building codes and all having outwardly flaring frontal portions 3 to receive counter sunk screw heads, being fastened onto two adjoining wall studs directly or over a drywall board and into the studs using screws long enough to assure sufficient penetration into the studs and using two anchor screws for two center holes 2 in the case of finished wall for permanent affix of part A to a vertical support. The four cylindrical elements 8 wear sleeves 23 shown in FIG. 6, having such inner diameter as to snug fit over and whole length of the cylindrical elements 8, having one-eighth inch wall thickness and made of spongy-rubber substance to provide the skis' surface a cushiony affect and maximum protection against mar and scratch.

The base 1 has a slot 11 at both ends, below the cylindrical elements 8 wherein two stretchable elastic members 12 shown in FIG. 5, are inserted sideways, turned 90 degrees and then pulled out so that their special configuration and design would hold and restrain themselves in place. The duty of these elastic elements 12 is to hold received skis in place by means of inserting a finger in the opening 13 provided, pulled out and let it be placed on already positioned ski edges where the elasticity of the elastic elements 12 draw its specially designed slot gap over the ski edges and lock them in place, preventing any accidental disengagement and fall of the skis.

The two lower sections, part B shown in FIG. 3 is designed to be fastened directly under each slot defined by two cylindrical elements 8 to accommodate and support the ends of a pair of skis.

Part B includes a rigid and smooth surface base element 14 which is a flat, rectilinear element defined by longer peripheral sides 15, and short top and bottom 16. Corners 7 of the base 14 are rounded for safety and appearance.

Dimensions of the base 14 are as follows: the length, width and depth measure about 6", 2" and 1" respectively.

The base 14 has a fixed pouch structure element 22, projecting perpendicularly outward, positioned horizontally in the center of base 14 for receiving ski ends, the element 22 has three additional structural elements, two side elements 17 and one bottom element 18, to provide structural stability and strength.

Dimensions of element 22 are not critical so far as having capacity of receiving and supporting a pair of ski ends comfortably that are in bottom-to-bottom facing arrangement.

The element 22 has two small holes 19 on the bottom face, permitting any snow melt or possible dirt accumulation to exit, this element 22 receives a protective lining 20 which also has two holes 21 that align with and serve the same purpose as the holes 19 of element 22.

Dimensions of the element 20 are such that it fits snugly into and covers the edges of element 22 and is made of a durable rubber substance to provide maximum protection for the stored skis.

The base 14 having two fastening holes 2 along the vertical axis, to be placed directly on the same vertical lines as two outward fastening holes 2 of base 1 of part A are positioned, consequently on centers of two adjacent wall studs, these two holes 2 also have outwardly flaring frontal portions 3 to receive counter sunk screw heads which follow the same installation procedure as part A with additional direction as follows: Each side of the proposed rack is designed to accommodate a pair of particular skis as far as the length of said skis are concerned, therefore in positioning part B along the vertical axis, the exact elevation must be found in order to have the weight of stored skis distributed between the two supporting parts A and B, whereby eliminating any warpage possibilities and preserving the skis' manufactured camber and long life.

In searching for the exact elevation of part B, said skis must be positioned in said slot of part A, allowed to come down and position themselves against the cylindrical elements 8 having sleeves 23 on whereby each front face of the ski tips leans against, before actually hanging from them, the elevation of inner bottom of element 20, positioned inside the element 22 must be where the elevation of said ski ends are.

The variation in elevation of parts B would regulate skis' weight distribution between parts A and B and also skis' camber.

Various other modifications may be made in details of design and construction without departing from the scope, essence and ambit of the invention.

I claim:

1. A storing rack for a single or double pairs of skis and ski poles, so designed to comfortably accommodate any two pairs of skis and ski poles, different or same in size and or type, grasping said skis at two extreme sections and across, utilizing gentle and mild substances, therefore eliminating any ski warpage or damage and providing maximum protection of said skis' manufactured camber and life, plus having means of securing said skis in place, comprising:

a) an upper base element formed of rigid and strong materials, peripherally defined by longer top and bottom and shorter sides, having means for fastening onto a studded or solid vertical wall, and two fixed cylindrical elements projecting outwardly at each end of said base element spaced to define a slot, formed of same materials as said base element and covered with sleeves having spongy-rubber material for receiving two pairs of ski tips in bottom-to-bottom facing arrangement and partially supporting the weight of said skis, and two cylindrical elements projecting outwardly at middle part of said base element, formed of same materials as said base element for receiving two pairs of ski poles of strapped or strapless, having caps at outward ends of said cylindrical elements to prevent unwanted release of said hanging ski pols;

b) two of a lower base element formed also of rigid and strong materials, peripherally defined by shorter top and bottom and longer sides, having means for fastening onto a studded or solid vertical wall directly below said defined slots of said upper base element, and an open container element projecting outwardly at middle of said lower base element, formed of same materials as said lower base element, having openings at bottom of said container element and consisting of a lining made of rubbery substance having the same and aligned openings to release undesirable substance accumulation, for receiving a pair of ski ends in bottom-to-bottom facing arrangement and supporting the remainder of said skis' weight partially supported by said cylindrical elements above, c) two elastic elements being attached to two ends of said upper base element near said slots, each to be pulled through its outer end and given opportunity for its specially designed slot gap to pull itself over said receiving skis along their edges to secure said skis in place.

2. A ski and ski pole storing rack according to claim 1 wherein the ski chamber and weight distribution over two supporting members, is regulated by the elevation of said lower base element, providing a fixed upper base element.

3. A ski and ski pole storing rack according to claim 2 where an upper and two lower base elements come to contact with individual pairs of skis' front tips and rear tails simultaneously, whereby distributing weight of said skis nearly equally between said upper and lower base elements, said physical phenomenon whereby any undesired pressure and or tension on any said skis' structural elements are eliminated, thereby preserving said skis' originally manufactured camber, designed performance and infinite life.

* * * * *